United States Patent [19]

Tendler

[11] 4,309,016

[45] * Jan. 5, 1982

[54] WALL HANGER

[76] Inventor: Robert K. Tendler, Buckridge Dr., Amherst, N.H. 03031

[ * ] Notice: The portion of the term of this patent subsequent to Feb. 25, 1992, has been disclaimed.

[21] Appl. No.: 921,041

[22] Filed: Jun. 30, 1978

Related U.S. Application Data

[60] Division of Ser. No. 831,092, Sep. 6, 1977, which is a continuation of Ser. No. 639,594, Dec. 10, 1975, abandoned, which is a continuation-in-part of Ser. No. 446,394, Feb. 27, 1974, Pat. No. 3,926,399, which is a continuation-in-part of Ser. No. 400,622, Sep. 25, 1973, Pat. No. 3,868,088, which is a continuation-in-part of Ser. No. 235,174, Mar. 16, 1972, Pat. No. 3,788,588.

[51] Int. Cl.[3] ..... A47F 7/14

[52] U.S. Cl. ..... 248/467; 248/489

[58] Field of Search ..... 248/467, 495, 496, 497, 248/498, 475 R, 489

[56] References Cited

U.S. PATENT DOCUMENTS

| | | | |
|---|---|---|---|
| 371,716 | 10/1887 | Stahle | 248/496 |
| 861,142 | 7/1907 | Rynek | 248/496 X |
| 2,385,296 | 9/1945 | Moore | 248/205 A X |
| 2,451,194 | 10/1948 | Braun | 248/205 A X |
| 2,498,139 | 2/1950 | Simjian | 248/467 |
| 3,444,597 | 5/1969 | Bone | 24/150 FP |
| 3,677,250 | 7/1972 | Thomas | 248/205 A |
| 3,788,588 | 1/1974 | Tendler | 248/467 |
| 3,868,086 | 2/1975 | Tendler | 248/467 |
| 3,926,399 | 12/1975 | Tendler | 248/467 |
| 4,029,285 | 6/1977 | Tendler | 248/467 |

FOREIGN PATENT DOCUMENTS

| | | | |
|---|---|---|---|
| 137153 | 1/1920 | United Kingdom | 248/496 |

*Primary Examiner*—William H. Schultz

*Attorney, Agent, or Firm*—Robert Kanof Tendler

[57] ABSTRACT

A wall hanger is disclosed in which a bow tie arrangement having porous end portions is mounted on the back of a picture to be hung on a wall. The bow tie is made to adhere to the back of the picture by the penetration of adhesive through the porous end portions, thereby to give strength to the hanging system. In one embodiment the adhesive is applied through the porous end portion and onto the picture backing, with the adhesive applied separately. In another embodiment, a bow tie type hanger is made of preformed and stretched nylon. In a still further embodiment, the hanger includes two separated pad portions with a flexible member between the pad portions in which the flexible member is offset from the plane of the pads to permit engagement of a hook when the hanger is adhesively attached to the back of a picture.

6 Claims, 17 Drawing Figures

WALL HANGER

REFERENCE TO RELATED APPLICATIONS

This application is a division of U.S. application Ser. No. 831,092 filed Sept. 6, 1977 which is a continuation of U.S. application Ser. No. 639,594 filed Dec. 10, 1975, now abandoned which is a continuation-in-part of U.S. application Ser. No. 446,394 filed Feb. 27, 1974, now U.S. Pat. No. 3,926,399, which is a continuation-in-part of U.S. application Ser. No. 400,622 filed Sept. 25, 1973, now U.S. Pat. No. 3,868,088, which is a continuation-in-part of U.S. application Ser. No. 235,174 filed Mar. 16, 1972, now U.S. Pat. No. 3,788,588.

BACKGROUND OF THE INVENTION

This invention relates to a method and apparatus for hanging pictures and the like and more particularly to a hanger comprising an elongated member such as a tape narrowed, collapsed or twisted on itself at a central region or a strand, with the ends of the member adapted to adhere to the structure to be mounted. The central portion of this member is made to lie in a region midway between the sides of the structure to be mounted on the wall and is engaged by a hook or a protrusion from the wall to permit hanging.

In the past there have been several methods of mounting pictures to walls involving adhesive members. Most recent of these involves the use of a "double sticky back tape." Depending on the tape used, pictures or posters mounted in this manner eventually either become disengaged from the wall or stick to the wall in such a manner that removal is made extremely difficult without damaging the wall or the picture. It will be appreciated in this type of adhesive mounting structure, that accurate centering is required since adjustment after the structure is mounted is difficult.

Another common adhesive type picture hanging structure is shown in U.S. Pat. No. 2,647,711 issued to J. M. Margulis on Aug. 4, 1953. In this method an adhesive strip is provided with an eyelet through which a metal hook attached to a further adhesive strip protrudes. The metal eyelet provides structural strength against tearing of the tape when the hole in the tape is slipped over the hook. It will be appreciated that this type of mounting method suffers from the same defect as the first mentioned mounting method in that proper centering and balancing is required when the adhesive strip is placed on the structure to be mounted. Thus no easy means of adjustment is provided once the strip is in place.

In contrast to these two methods of mounting structures on a wall, the subject system involves a member which may be a continuous adhesive tape which is either narrowed or twisted on itself at a central region, or a strand with adhesive means at either end. This member is elongated and is adapted to engage a hook or protrusion on the wall. The elongated portion serves much the same function as the traditional wire used in picture hanging, in that adjustment of the picture on the wall is accomplished by changing the fulcrum by sliding the hook along the elongated portion.

In contrast to conventional wire techniques, no screws or nails need be attached to a picture to support a wire when using the subject adhesive hanger.

Additionally, the manufacture of such a hanging device is extremely simple, since it will be appreciated that there need be no metal parts to complicate the manufacturing process.

Although initially it might seem that a member used in this manner would come off of the structure to be mounted, it has been found that this particular method and apparatus holds heavy structures in place on a wall for considerable lengths of time. Although this particular mounting system was adapted primarily for mounting picture board of light weight nature to a wall, it has been found that due to the availability of strong tear resistant tapes and strands, and extremely adherent adhesives, structures of considerable weight may be mounted in this manner.

It has also been found that such a bow tie structure can be fabricated from molded nylon in a pull-trusion process by which the elongated central portion is as strong as picture wire. In one embodiment, the ends of the bow tie are made porous by aperturing so that adhesive between the bow tie and the picture to be mounted will harden in the apertures to provide a stable mechanical as well as a chemical bond to the nylon. For this purpose a separate tube of adhesive may be provided with the bow ties, if the bow ties do not themselves carry the adhesive. Porous tapes narrowed on themselves in a central region can also be used in place of the nylon bow tie. Moreover, with some adhesives the pull-truded nylon bow tie neew not be apertured. In other embodiments the bonding surface of the nylon bow tie ends may be pretreated as by scoring, roughening or by chemical treatment. Additionally, the pull-truded part need not be made of nylon, but can be made of any suitable pull-truded material.

It will be appreciated that if a flat bow tie-like structure is laid on the back of a picture and adhesive is applied, then the strand portion will lie adjacent the picture backing material making engagement with a picture hook difficult as well as subjecting the hanger to undue stress. Thus in a still further embodiment the strand or flexible member of the hanger intermediate the tab or pad portions is offset from the plane of the pads to permit easy picture mounting.

SUMMARY OF THE INVENTION

It is therefore an object of this invention to provide apparatus for hanging a structure on a wall including a member having adhesive means at either end for mounting the member on the structure to be supported, the central or intermediate region of the member being offset from the ends to enable the engagement of a hook or protrusion from the wall.

It is another object of this invention to provide a bow tie like structure with an elongated central portion in which the end portions are porous to permit both a mechanical and adhesive bond by the hardened adhesive at the bow tie ends, while at the same time permitting penetration of the adhesive into the picture backing material.

It is a further object of this invention to provide an improved picture hanging method in which a bow tie like structure is adhered to the back of a picture via adhesive applied through porous or apertured end portions of the bow tie.

It is another object of this invention to make a hanger having a generally bow tie type configuration out of pull-truded material.

It is a still further object of this invention to provide a method for hanging a structure on a wall comprising the steps of taking a continuous piece of adhesive tape and twisting it on itself so to form a central region and adhering the tape to the structure to be supported on the wall.

It is a still further object of this invention to provide a method for mounting a structure to a wall comprising the steps of twisting an adhesive tape on itself so as to form a central region, affixing the adhesive tape to the structure to be mounted, affixing a mechanical protrusion to the wall, and placing the central twisted portion of the tape over the protrusion.

It is a still further object of this invention to provide a method and apparatus for hanging a structure on a wall including a piece of continuous tape narrowed on itself in a central region which is overlaid with material for increasing the structural integrity of the central region and permitting ease of manufacture.

Other objects of the invention will be better understood from the accompanying specification, drawings, and appended claims.

DETAILED DESCRIPTION OF THE INVENTION

Figure 1:
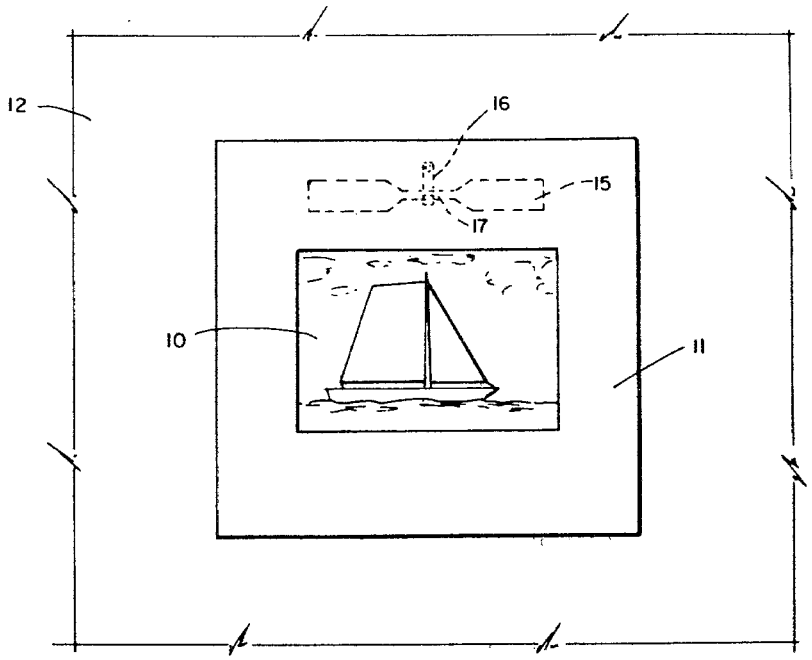
FIG. 1 is a diagramatic representation showing a picture hung on a wall showing the mounting apparatus in dotted outline.
Figure 2:
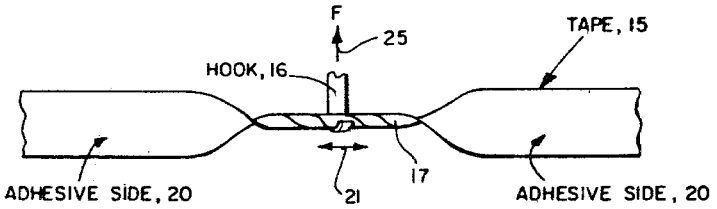
FIG. 2 is a schematic diagram of the tape utilized as the mounting means, showing the tape twisted on itself so as to form a central region and showing the engagement of a hook with the central region, which hook may be moved in a lateral direction so as to permit balancing of the picture on the wall.

Referring to FIG. 1, there is shown a picture 10 mounted on a mounting board 11 which is fixedly attached to a wall shown by the reference character 12. The adhesive tape mounting apparatus is shown in dotted outline by continuous tape 15. A hook is shown at 16 to be mechanically attached to the wall. The structure 11 is supported by the engagement of the hook with a central portion 17 of the continuous tape 15 which central portion is a portion of the tape twisted on itself. As illustrated in FIG. 2 in one form the central portion is a helically wound generally cylindrical portion which may be made to adhere to itself for strength as described hereinafter. The term "adhesive tape" as used herein refers generally to pressure-sensitive tapes, water-activated tapes and heat-sensitive tapes. In addition, this term includes any tape which adheres to the structure to be supported.

Referring now to FIG. 2, the tape and hook combination is shown with like numbers denoting corresponding elements in FIG. 1. From FIG. 2, it will be appreciated that in one embodiment the tape has a single adhesive side shown by the reference character 20. This adhesive side is the same at either end of the central region 17 so as to adhere to the structure to be supported. As can be seen from the double ended arrow 21, the hook 16 can be moved laterally so as to provide the proper fulcrum for the hanging structure thereby facilitating easy alignment for balancing of a picture on a wall.

From FIG. 2 it will be seen that the force of the hook on the tape is shown by the arrow 25 to be in an upward direction. This direction is biaxial to the length of the continuous tape. It will be appreciated that in many of the prior art handles for structures, tape is utilized in which the force on the handle is along the axis of the tape and not in a biaxial direction as shown in FIG. 2. For the purposes of this description, "biaxial" refers to a direction in the plane of the tape perpendicular to the longitudinal axis of the tape. Thus a force perpendicular to the plane of the paper on which FIG. 2 is drawn would be excluded from the term biaxial. One advantage of the subject approach lies in the fact that a biaxial force as hereinbefore defined does not cause the tape to rip or tear. Nor does the force result in a shear force of such a magnitude so as to cause the tape to separate from the structure to be mounted. It will be therefore appreciated that a continuous tape twisted on itself in and of itself, without mechanical or metal braces is sufficient alone to be used in combination with a hook as shown in FIG. 2.

It will be apparent that the adhesive qualities of the tape as well as the width of the tape and the material of which the tape is made will materially determine the weight of the structure which can be mounted in this manner. It is however well within the state of the art to utilize tape to support structures of considerable weight. Examples of such tapes are shown in U.S. Pat. Nos. 2,647,711 issued Aug. 4, 1953 and 3,294,355 issued Dec. 27, 1966.

In general, tapes suited for this application fall into three categories: pressure-sensitive, water-activated, and heat-sensitive. The pressure-sensitive tapes generally use rubber base or acrylic adhesives on backing materials such as acetate, cellophane, polyester, vinyl, cloth and paper. These tapes may be reinforced as in the case of acetate and polyester backing materials by using fiber reinforcing materials such as rayon or glass. The water-activated tapes usually use paper or cloth backing materials in combination with animal or vegetable glues including casein and starch. These tapes are wetted prior to applying the tape to the back of a picture. The heat-sensitive tapes are made from the thermosetting type resins which need only heat to cure. Heat-sensitive tapes are in general made from polyester, epoxy, or phenolic base materials in which the tape is ironed on to the picture. In the first type of tape mentioned, the pressure-sensitive adhesive adds to the strength of the central twisted region once the tape with the adhesive is twisted. In the latter two types of tape, the central twisted region may be made to adhere to itself prior to use, by applying either water or heat to the central region. This adds the strength of the adhesive to the inherent strength of the twisted tape. Under most loading conditions, this additional strengthening is not necessary. In any case, the tape backing and adhesive is chosen to be adequate for the load supported. Obviously, adhesive also includes glue and epoxy resins which may be applied to the tape just prior to mounting. Further, any combination of the above tape backings and adhesives are within the scope of this invention.

Figure 3:
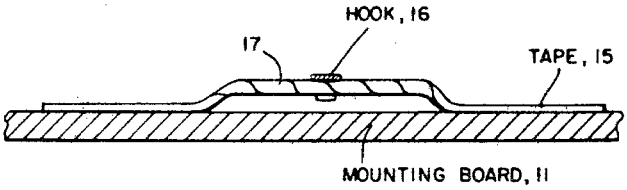
FIG. 3 is a top view of the structure to be mounted to a wall showing in side view the tape and the hook utilized in mounting the structure to the wall.

Referring now to FIG. 3, the top view of the subject apparatus is shown in which the mounting board 11 is connected to the hook 16 by the tape 15 formed in the manner described. It will be appreciated that the mounting board can be balanced by moving the hook 16 along the central portion 17 of the tape 15.

From the foregoing it will be appreciated that there are many types and widths of tape which will be suitable depending upon the weight and consistency of the structure to be mounted adjacent the wall. The system thus far described relies on both mechanical and adhesive properties used in combination so as to support the structures of relatively great weight as compared to those supportable by hangers having solely adhesive-backed coacting members.

There are however other configurations of the tape which when twisted upon itself will provide for even greater mechanical stability of the mounting.

Figure 4:
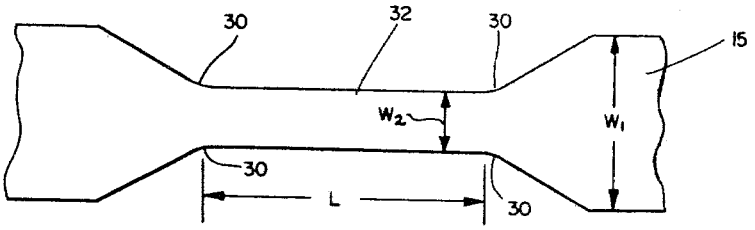
FIG. 4 shows an alternate embodiment of tape configuration in which a narrow central portion is formed and in which the transition from the narrow central portion to a wider portion is made in a continuous curve.

In one embodiment shown in FIG. 4, the tape 15 is made extremely wide except for a central portion 32 having a length denoted by the character L. This figure shows the tape prior to being twisted on itself so as to form the central region 17 of FIGS. 1, 2, and 3. In this embodiment there is a first width of tape denoted by the symbol $W_1$ which is the major portion of the tape to adhere to the structure to be mounted. The central region 32 is to be formed by the narrow portion of the tape 15 designated by character $W_2$. It will be appreciated from this figure that the transition between the width $W_2$ and the width $W_1$ is continuous as shown by the continuous lines 30. The continuity of these lines prevents shear forces from tearing the tape once the picture is hung.

Figure 5:
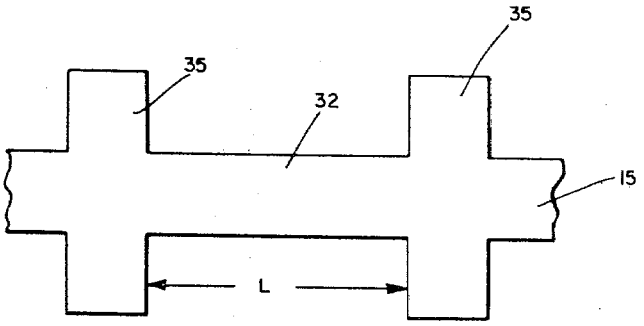
FIG. 5 is a further embodiment showing a tape configuration in which biaxial integral supporting strips are provided to add strength to the tape portion of the mounting apparatus.

If additional support is required, the tape may be configured as shown in FIG. 5. In this case, the tape 15 is provided with two biaxial strips 35 at right angles to the tape prior to its being twisted on itself. Assuming the tape to be of a quality which does not easily tear, the right angles between the tabs 35 and the tape body will not be a factor in the failure of a system utilizing this type of tape. Again it is the length L of the tape which is to be twisted on itself to provide the central region.

In one further embodiment once the tape is in place on the structure to be mounted on the wall, additional tape strips 40 may be placed over the tape in a position shown so as to provide increased mechanical stability of the mounting system.

Figure 6:
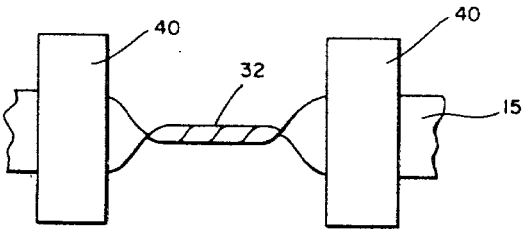
FIG. 6 is a diagram showing the use of biaxially oriented separate pieces of tape which may be used to support the structure to be mounted.

It will, however, be appreciated that the strips 40 need not be used in a large variety of cases where the structure to be mounted to the wall is relatively light. Such would be in the case in photographic mounting board or poster board as it is sometimes called. It is a relatively simple packaging matter to provide a package in which the far ends of the tape can be detached from the majority of the tape so as to provide for the cross pieces 40 as shown in FIG. 6.

There has therefore been provided an extremely easy and inexpensive method and apparatus for mounting structures to a wall or vertically extending structure. The major factors which permit such an easy mounting are the structural strength of the tape twisted on itself re tearing and also the uncommon resistance of the tape to pulling away when a biaxial force as described hereinbefore as applied to the tape. Further, the central twisted portion of the tape can be made to adhere to itself to provide for increase strength. There should also be considered the ease of centering and balancing provided by the method and apparatus described which is unlike adhesive systems in the prior art. It will be appreciated that tape twisted on itself could be dispensed from a roll in much the same way as cellophane or adhesive tape is dispensed, with a cutting portion of the dispenser serving to separate the individual pieces of tape necessary for each mounting application.

Referring now to FIGS. 7–10 an alternative embodiment is illustrated in which the narrowed portion of the tape is overlaid, overwrapped or coated with a material which aids in the structural integrity or stability of the central portion. This type construction also simplifies manufacture since the narrowing of the tape at the central portion can be accomplished at the wrapping stage.

Figure 7:
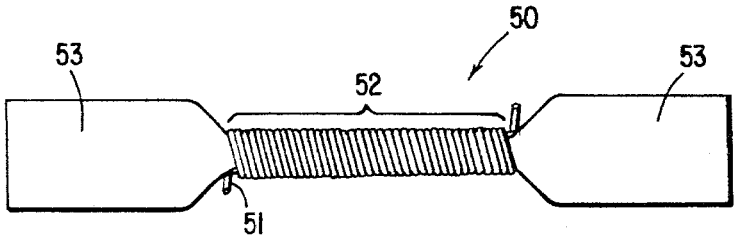
FIG. 7 is a diagram showing the central portion of the tape helically wound with a strand.
Figure 8:
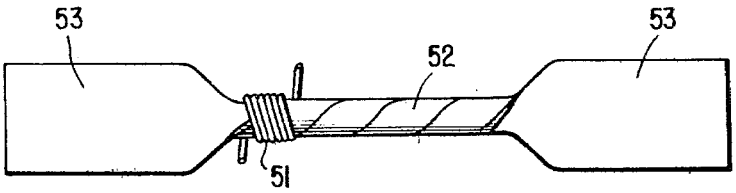
FIG. 8 is a diagram showing a twisted central tape portion overwound with a strand.

In one embodiment, illustrated in FIG. 7, the already formed hanger 50 is provided with a helically wound strand 51 which surrounds a generally cylindrical portion 52 formed in any of a variety of ways as will appear hereinafter. As can be seen, tape flat portions 53 adjacent central cylindrical portion 52 are free of the strand, although the strand ends may be embedded therein if desired.

Strand 51 may be adhesively attached to the central portion, either by precoating the strands with a suitable adhesive, or by saturating the strands after winding.

Figure 9:
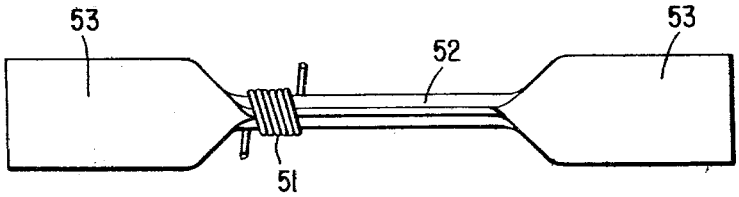
FIG. 9 is a diagram showing a narrowed central tape portion overwound with a strand.

The central cylindrical portion 52 may be formed in a variety of ways. For instance, the tape may be twisted on itself as in FIG. 8 to form a central core, with strand 51 overlaying the core. Alternatively, as illustrated in FIG. 9 the tape may simply be collapsed on itself in its central region and overlying material supplied to aid in structural stability and integrity as well as maintaining the narrowed central region in a generally cylindrical configuration.

It will be appreciated, that from a generic point of view strand 51 is an overlying material.

Figure 10:
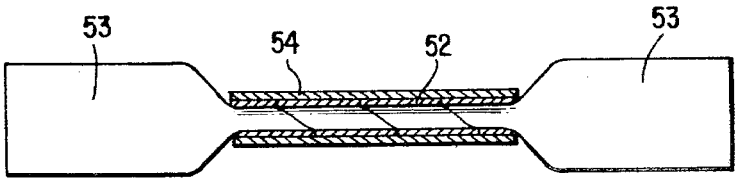
FIG. 10 is a partial cross sectional diagram showing a central tubular portion overlaid with a coating layer.

In FIG. 10 the central portion 52 is overlaid with either a coating of cylindrical member 54 which maintains the structural integrity of the central core. Member 54 can be a coating, a cylinder crimped or adhesively attached in place, or any member which surrounds the core whether or not adhesively attached thereto.

Thus the embodiments of FIGS. 7–10, in addition to having all the advantages of the embodiments of FIGS. 1–6 also permit certain economies of manufacture in that the tape can be collapsed or narrowed on itself, with or without an outer winding to provide structural integrity to the hanger.

As can be seen, the generic concept is that of an elongated member having adhesive means at the ends thereof to provide a hanger which is both easy to make and is easy to apply. Moreover, the hanger is easily engaged by a picture hook at an intermediate section thereof.

While the holding properties of the aforementioned hanger have been exceptional, even further mechanical stability of the hanger has been achieved through the use of porous end structures for the bow-tie like hanger.

When porous open weave tape is used applying adhesive through the tape, from either direction has resulted in penetration of the adhesive into the tape as well as into the backing material of the picture. This provides an exceptional mechanical bond because of the penetration as well as an increased chemical bond because of the increased surface area wetted by the adhesive.

The possibility of molding the hangers from a plastic or other similar material has been somewhat illusory because of certain bonding problems. This is especially true of nylon. However when bow ties are made of nylon with apertured end portions satisfactory holding power is achieved when the adhesive is allowed to penetrate the bow tie through the apertures. Alternatively, the nylon bow tie ends may be either mechanically or chemically treated for increasing bond strength.

Moreover, with the development of the so called pull-trusion process of U.S. Pat. No. 3,444,597 issued to A. R. Bone on May 20, 1969 and incorporated by reference herein a flexible thermoplastic filament or strand is given improved strength by stretching to reduce its cross sectional dimensions and increase its strength by rearranging the molecules of the thermoplastic material. It is thought that the increased strength comes from the long chain molecules lining up along the axis of pull. Materials which may be "pull-truded" include nylon, polypropylene and polyethylene. Thus a bow tie like structure can be manufactured in which the pull-truded central portion is both flexible and strong enough to support articles of considerable weight. For added strength the article may be formed with a wire running longitudinally down the center of the hanger.

Figure 11:
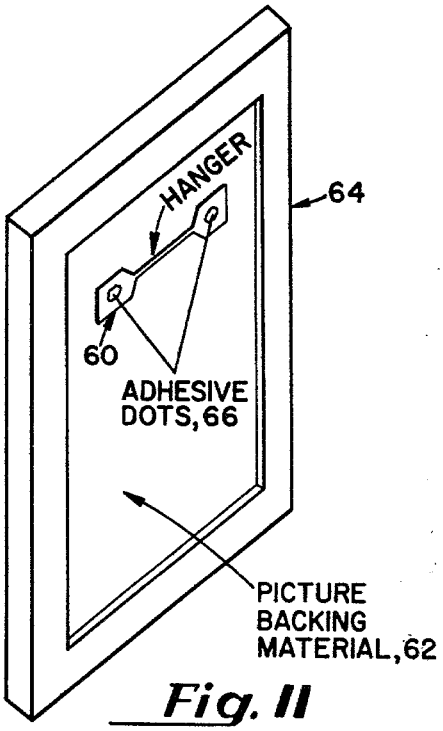
FIGS. 11–16 show alternative embodiments of a hanger in which the bow tie like member is provided with porous ends to permit penetration of adhesive.

The method by which the apertured bow tie structure is mounted is illustrated in FIG. 11 in which a bow tie structure 60 is applied to the back 62 of a picture 64 in one method by first laying the hanger on the back of the picture and then applying adhesive through the hanger and onto the picture backing material as illustrated by adhesive dots 66. Alternatively the adhesive dots may be placed on the picture backing material and the hanger then pressed onto the adhesive dots.

Figure 12:
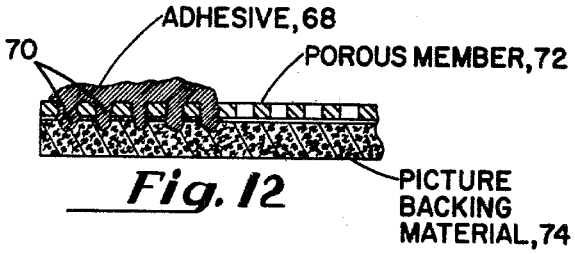
Figure 13:
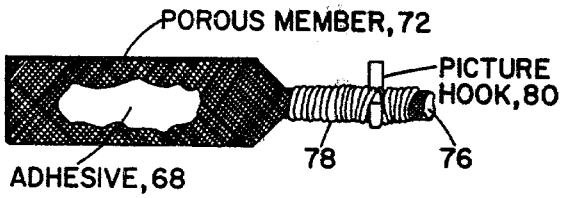

The structure that results is illustrated in FIG. 12 in which adhesive 68 surrounds apertures 70 in porous member 72. The adhesive also penetrates into the picture backing material here illustrated at 74. Thus there is double penetration and enhanced mechanical stability. As mentioned, the porous member may be an open weave tape or apertured plastic. FIG. 13 is a top view illustrating the adhesive dot and porous end member.

A portion of the elongated central portion of the bow tie like structure is illustrated at 76 to be overwrapped with a strand 78 loosely adhered thereto. When the picture is in place, picture hook 80 separates the strand at its point of contact due to the weight of the picture. This prevents a change of the fulcrom of the hung picture which is the major cause of off-centering of a picture which is originally properly centered.

Thus the overwrapping with a strand loosely adherent to the elongated central portion of the hanger provides for the maintenance of picture centering.

Figure 14:
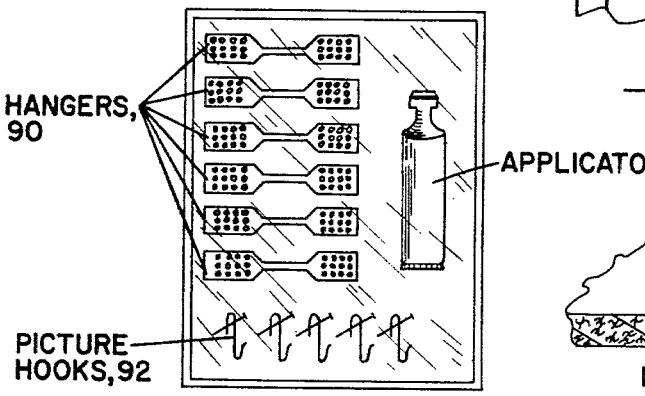

Referring now to FIG. 14 a number of hooks 92 and an adhesive for the hangers may be provided separately, thus permitting practicing of the above mounting method at the site of the picture mounting. This provides a relatively large quantity of viscous liquid which will penetrate the hanger. It will be appreciated that this quantity of liquid adhesive would be difficult to provide as a film already on the hanger.

Figure 15:
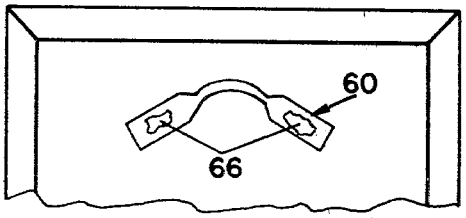

FIG. 15 illustrates the fact the hanger need not be mounted horizontally, but may be mounted at an angle for added strength without loss of the ability to center the picture.

Figure 16:
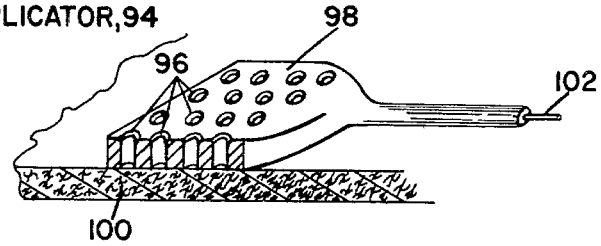

FIG. 16 illustrates a portion of the pull-truded hanger embodiment in which apertures 96 are provided in the bow tie end portion 98 which is adhered to backing material 100, with a reinforcing wire 102 running longitudinally through the hanger.

Figure 17:
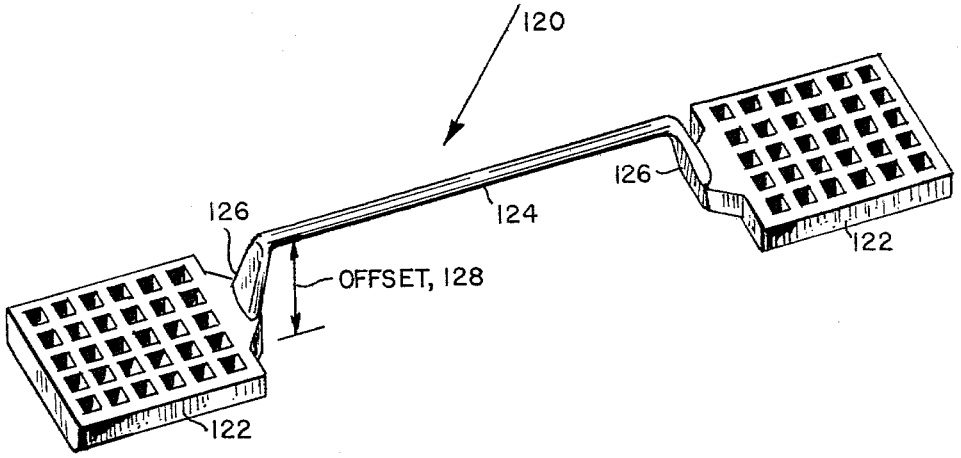
FIG. 17 is an isometric illustration of a unitary hanger with an offset flexible member and apertured pad portions.

Finally, with respect to FIG. 17, a unitary resinous hanger 120 may be provided with apertured pad portions 122 lying in one plane and an offset flexible member 124, here in the form of a strand, attached between the pad portions by riser members 126. As can be seen, the offset is illustrated by arrow 128. The strand therefore lies in a plane parallel to but offset from the plane in which the pad portions lie. The direction of the offset is away from the surface of the pad portions adapted to lie against the picture backing material. Were it not for the offset, the placing of the hanger on the back of the picture and gluing it to the picture would result in both undue stress on the hanger and difficulty in having the picture hook engage the strand.

What has therefore been provided is a novel hanger having a bow tie configuration with the ends being apertured or porous to permit adhesive to pass therethrough and harden. Additionally a bow tie hanger of pull-truded material has been provided whether the ends have been apertured or not. Moreover, if the bow tie ends are apertured, a process is provided in which adhesive is forced through the apertures to be able to take advantage of the holding power of liquid adhesives as well as the penetrating property of the liquid adhesive. It will be appreciated that the penetration of the backing material is important because the backing material may be weak and the penetrating liquid adhesive, when hardened provides increased mechanical stability for the backing material. In the case of cardboard this prevents delamination and in the case of fiberboard this prevents failure due to the fibers coming away. Moreover, an offset central portion of the hanger provides ease of hanging and the entire hanger can be made as a unitary resinous structure.

While particular embodiments of the invention have been described it will be understood that various modifications may be made which fall within the true spirit and scope of the invention claimed.

I claim:

1. A method of hanging a structure on a wall, in which the wall is provided with a member projecting therefrom, comprising the step of:

affixing to the back of the structure to be hung a unitary article of resinous material including two flat separated pad portions and an integral, flexible member depending between and attached to said pad portions, said structure with said unitary article affixed being adapted to be hung on the wall such that the flexible member passes over the projecting member.

2. The method of claim 1 wherein said unitary article is molded.

3. The method of claim 2 wherein the flexible member of said molded article is stretched after molding.

4. The method of claim 1 wherein said affixing step includes the step of providing the pad portions with apertures and dripping adhesive through the apertures.

5. The method of claim 1 wherein said unitary article is made of thermoplastic material.

6. The method of claim 5 wherein said thermoplastic material is nylon.

* * * * *